US011574786B2

(12) United States Patent
Thingstad Pettersen et al.

(10) Patent No.: US 11,574,786 B2
(45) Date of Patent: Feb. 7, 2023

(54) FUSE ADAPTER KIT FOR A FUSE OF A SWITCH-FUSE MODULE

(71) Applicant: ABB Schweiz AG, Baden (CH)

(72) Inventors: Terje Thingstad Pettersen, Skien (NO); Ståle Talmo, Skien (NO); Stanley Lohne, Porsgrunn (NO); Elham Attar, Skien (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/653,944

(22) Filed: Mar. 8, 2022

(65) Prior Publication Data

US 2022/0293386 A1 Sep. 15, 2022

(30) Foreign Application Priority Data

Mar. 11, 2021 (EP) ..... 21162053

(51) Int. Cl.
*H01H 85/20* (2006.01)
*H01H 85/042* (2006.01)

(52) U.S. Cl.
CPC ..... *H01H 85/2015* (2013.01); *H01H 85/042* (2013.01); *H01H 2085/209* (2013.01); *H01H 2085/2065* (2013.01)

(58) Field of Classification Search
CPC ..... H01H 85/042; H01H 85/2015; H01H 2085/2065–209
See application file for complete search history.

(56) References Cited

U.S. PATENT DOCUMENTS 3,522,404 A * 8/1970 Trayer ..... H01H 9/16 337/204
3,533,041 A * 10/1970 McConnell ..... H01H 85/042 337/186

(Continued)

FOREIGN PATENT DOCUMENTS

| | | |
|---|---|---|
| DE | 1941745 U | 7/1966 |
| FR | 2589640 A1 | 5/1987 |
| JP | S52134623 U | 10/1977 |

OTHER PUBLICATIONS

Extended European Search Report; Application No. 21162053.9; Completed: Aug. 19, 2021; dated Sep. 2, 2021; 6 Pages.

*Primary Examiner* — Jacob R Crum
(74) *Attorney, Agent, or Firm* — Whitmyer IP Group LLC

(57) ABSTRACT

A fuse adapter kit for a fuse of a switch-fuse module and a switch-fuse module. The fuse adapter kit includes: a fuse canister having an axially elongated fuse receiving portion adapted to receive the fuse; and at least one terminal having i) an axial fuse receiving opening for receiving an axial end portion of the fuse, ii) a lateral protrusion forming a mechanical male connector, and iii) an electrical terminal connector laterally arranged within the mechanical male connector for electrically connecting the fuse to an electrical canister connector; wherein the fuse canister has a fuse mounting wall portion extending axially along a back side of the fuse receiving portion, the fuse mounting wall portion having at least three fuse mounting openings at different axial positions along the fuse mounting wall portion, each of the fuse mounting openings forming a mechanical female connector matching the mechanical male connector of the terminal to form a mechanical plug connection, and wherein the fuse canister further includes the electrical canister connector arranged at at least one of the fuse mounting (Continued)

openings for electrically connecting to the electrical terminal connector.

23 Claims, 2 Drawing Sheets

(56) References Cited

U.S. PATENT DOCUMENTS

| | | | | |
|---|---|---|---|---|
| 3,839,692 | A * | 10/1974 | Plasko | H01H 85/044<br>337/182 |
| 5,951,328 | A * | 9/1999 | Roper, Jr. | H01H 85/2035<br>439/620.27 |
| 2003/0218528 | A1* | 11/2003 | Stavnes | H01H 85/38<br>337/186 |
| 2007/0259559 | A1* | 11/2007 | Borchardt | H01H 85/20<br>439/412 |
| 2007/0293073 | A1* | 12/2007 | Hughes | H01H 33/66207<br>439/186 |
| 2010/0039789 | A1* | 2/2010 | Mason | H02B 11/26<br>361/833 |
| 2010/0218373 | A1* | 9/2010 | Yaworski | H01H 85/201<br>29/868 |
| 2016/0268090 | A1* | 9/2016 | Jordan | H01H 85/202 |

* cited by examiner

FUSE ADAPTER KIT FOR A FUSE OF A SWITCH-FUSE MODULE

TECHNICAL FIELD

Embodiments of the present disclosure relate to a fuse adapter kit, in particular to a fuse adapter kit for a fuse of a switch-fuse module that provides increased flexibility in terms of customisation to the user environment. Embodiments of the present disclosure also relate to a switch-fuse module including the fuse adapter kit.

BACKGROUND

A large number of area secondary substations including medium- or high-voltage equipment is required to distribute power to end customers in urban and rural areas. Due to the increasing or fluctuating population of many cities and the associated change in urban areas, public supply companies are confronted with the challenge of adapting fast to varying conditions.

In the context of such demands from customers of medium- or high-voltage equipment, there is a significant need for an easy and flexible adaptation of the equipment to changing urban requirements in a cost-effective manner.

Terms and Definitions

This application uses terms whose meaning is briefly explained here.

The term axial refers to a longitudinal axis of an element or unit. The term longitudinal refers to a direction in which the element has the greatest spatial extension and/or a symmetry axis. The term lateral refers to a direction perpendicular to the longitudinal axis, in which the object has the second largest extension and/or which is parallel to a horizontal direction when mounted in a regular mounting orientation. An axial direction refers to a direction parallel to the longitudinal axis of the element.

Value ranges defined as x1, or x2, etc. to y1, or y2, etc. mean that the values are within intervals such as x1 to y1, or x1 to y2, or x2 to y1, or x2 to y2, etc.

An x- and z-direction as shown in FIG. 2*a* may be perpendicular to each other and may define a horizontal or x-z plane. The y-direction may then be a vertical direction, perpendicular to the horizontal plane. A view of the switch-fuse module in a direction perpendicular to z-y plane may be a side view. Accordingly, a footprint may be in the horizontal plane. Similarly, a view of the switch-fuse module in a direction perpendicular to x-y plane may be a front or back view. Terms such as "vertical" and "horizontal" may refer to the respective directions when the switch-fuse module is mounted in a regular mounting orientation in which the module is ready for operation, especially with an operating panel oriented on a vertical front face of the switch-fuse module.

The terms "above" and "below" refer to positions that differ with respect to the y-axis. An object A is positioned above (or below) an object B if the y-coordinate of the centroid of object A has a higher (or lower) value than the y-coordinate of the centroid of object B.

The terms "front" and "back" refer to positions that differ with respect to the z-axis. A first position is referred to as a front (or back) relative to a second position if the z coordinate of the first position has a lower (or higher) value than the second position. For example, the front (or back) of a module is the region which substantially has the lowest (or highest) z-coordinate of the module. The front is the side of the object usually facing a user or operator.

A height of an object may be understood as an object extension in the y direction, a depth may be understood as an object extension in the z direction, and a width may be understood as an object extension in the x direction.

In this document, "or" is understood as a non-exclusive disjunction. Accordingly, the link "A or B" expresses that at least one of the involved statements A, B is true.

Furthermore, the terms "a" or "the", such as in the expression "a fuse" or "the fuse", are used to refer to at least one fuse. The quantity "a" or "the" includes the quantity "at least one". If the term "at least one" is used explicitly, a subsequent use of "a" or "the" does not imply any deviation from the aforementioned principle according to which "a" or "the" is to be understood as "at least one".

The terms "substantially" or "basically" as used herein typically imply that there may be a certain deviation, e.g. up to 1%, up to 3% or up to 10%, from the characteristic denoted with "substantially".

SUMMARY

In view of the above, a fuse adapter kit for a fuse of a switch-fuse module and a switch-fuse module according to the claims, having a fuse adapter kit are provided.

According to an aspect of the present disclosure, a fuse adapter kit for a fuse of a switch-fuse module is provided. The fuse adapter kit includes: a fuse canister, preferably formed as a hollow body, having an axially elongated fuse receiving portion adapted to receive the fuse, and at least one terminal.

The terminal has i) an axial fuse receiving opening for receiving an axial end portion of the fuse, ii) a lateral protrusion forming a mechanical male connector, and iii) an electrical terminal connector laterally arranged within the mechanical male connector for electrically connecting the fuse to an electrical canister connector.

The fuse canister has a fuse mounting wall portion extending axially along a back side of the fuse receiving portion. The fuse mounting wall portion has at least three fuse mounting openings at different axial positions along the fuse mounting wall portion. Each of the fuse mounting openings forms a mechanical female connector matching the mechanical male connector of the terminal, which may be also referred to as mechanical terminal connector, to form a mechanical plug connection.

The fuse canister further includes the electrical canister connector arranged at at least one of the fuse mounting openings for electrically connecting to the electrical terminal connector.

According to another aspect of the present disclosure, a switch-fuse module is provided. The switch-fuse module unit includes the fuse adapter kit.

Some advantages relating to the fuse adapter kit and the switch-fuse module are described as follows.

An advantage, based on the plurality of fuse mounting openings and/or the terminal structure, is that a variety of fuses of different lengths can be used.

An advantage, based on the adjustability for fuses with different lengths, is that the switch-fuse module can be used for voltages or currents of different magnitudes.

An advantage, based on the adjustability for voltages of different magnitudes, is that adaptation to electrical customer requirements is made possible without additional costs, which is associated with competitive advantages.

Further aspects, advantages and features of the present disclosure are apparent from the dependent claims, the description, and the accompanying drawings.

BRIEF DESCRIPTION OF THE DRAWINGS

So that the manner in which the above recited features of the present disclosure can be understood in detail, a more particular description of the present disclosure, briefly summarized above, may be had by reference to typical embodiments. The accompanying drawings relate to embodiments of the present disclosure and are described in the following.

DETAILED DESCRIPTION

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described.

The reference numbers of the figures are used merely for illustration. The aspects of the invention are not limited to any particular embodiment. Instead, any aspect or embodiment described herein can be combined with any other aspect or embodiment described herein unless specified otherwise.

Figure 1B:
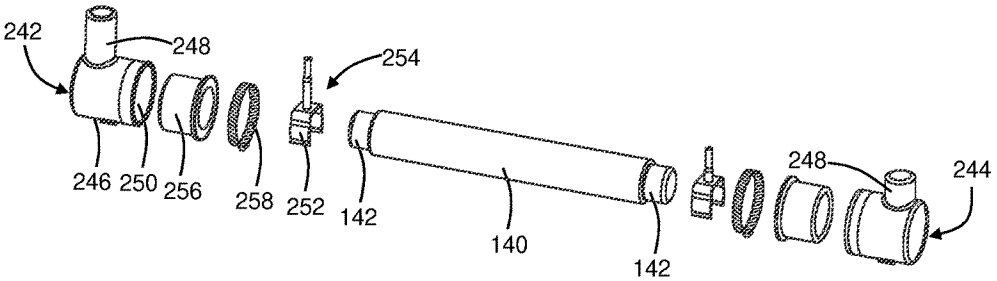
FIG. 1*b* shows an exploded view of components related to a terminal of a fuse adapter kit, when applied to a fuse, according to embodiments described herein.
Figure 1C:
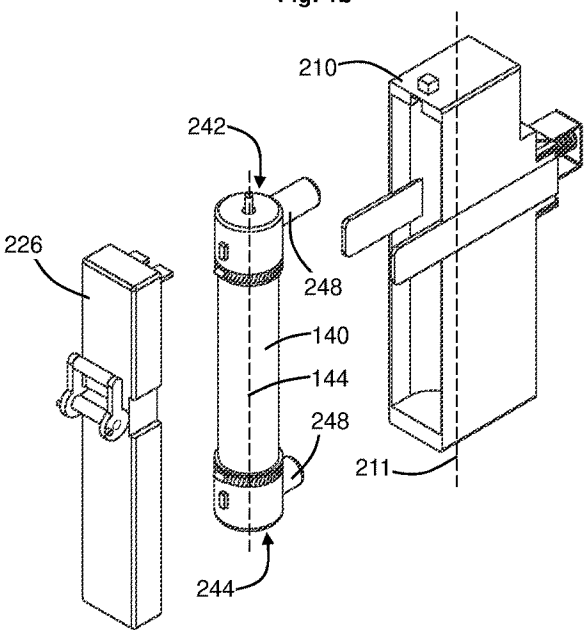
FIG. 1*c* shows a perspective 3D view of a fuse adapter kit, when applied to a fuse, according to embodiments described herein.
Figure 1A:
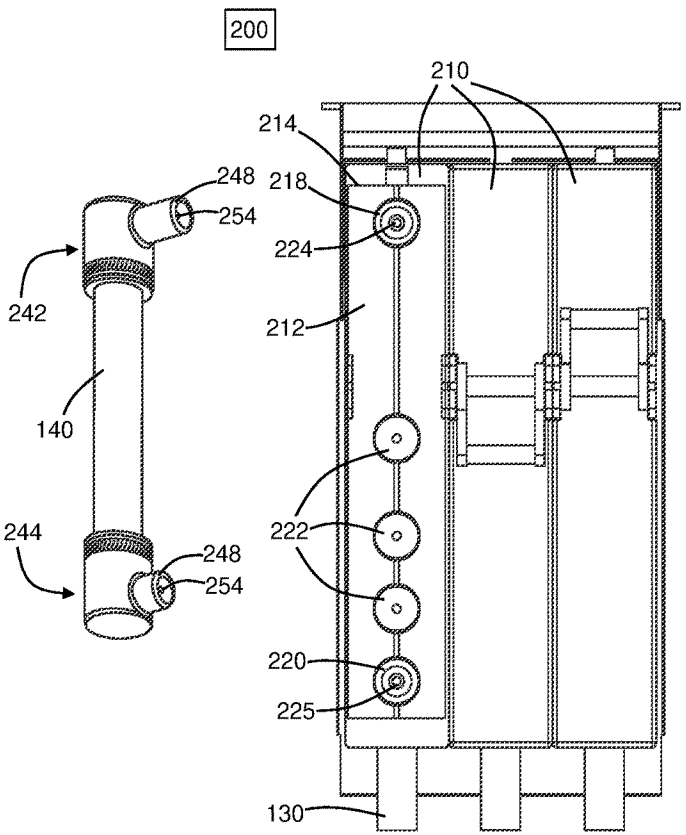
FIG. 1*a* shows a fuse adapter kit according to embodiments described herein.

FIG. 1*a* shows a fuse adapter kit, FIG. 1*b* shows an exploded view of components related to a terminal of a fuse adapter kit, when applied to a fuse, and FIG. 1*c* shows a perspective 3D view of a fuse adapter kit, when applied to a fuse, according to embodiments of the present invention. Details explained with illustrative reference to FIGS. 1*a*, 1*b*, 1*c* shall not be understood as limited to the elements of FIGS. 1*a*, 1*b*, 1*c*. Rather, those details may also be combined with further embodiments explained with illustrative reference to the other figures.

According to embodiments described herein, a fuse adapter kit 200 for a fuse 140 of a switch-fuse module 100 may include: at least one terminal 242, 244, and a fuse canister 210 having an axially elongated fuse receiving portion 214 adapted to receive the fuse 140 (or the fuse-terminal unit described herein).

The terminal 242, 244 may be formed as an end piece that can be placed on an axial end portion 142 of the fuse 140 to establish electrical contact between the fuse and an outer region of the fuse, preferably via an electrical connection lateral to the fuse 140. The fuse adapter kit 200 preferably includes two terminals 242, 244, one for each axial end portion of the fuse 140. The fuse 140 in combination with the terminal(s) 242, 244 placed on the (respective) axial end portion(s) of the fuse form a fuse-terminal unit.

The terminal 242, 244 may have i) an axial (mechanical) fuse receiving opening 250 for receiving the axial end portion 142 of the fuse 140, ii) a lateral protrusion 248 forming a mechanical male connector, and iii) an electrical terminal connector 254 laterally arranged (partially or fully) within the mechanical male connector 248 of the terminal 242, 244 for electrically connecting the fuse 140 to an electrical canister connector 224, 225 (of the fuse canister 210).

The fuse canister 210 may have a fuse mounting wall portion 212 extending axially (in a, e.g., vertical, plane adapted to comprise the axial direction of the fuse when operationally mounted to the fuse mounting wall portion as described herein) along a back side of the fuse receiving portion 214. The fuse mounting wall portion 212 may have at least three fuse mounting openings 218, 220, 222 at different axial positions along the fuse mounting wall portion 212, each of the fuse mounting openings 218, 220, 222 forming a mechanical female connector matching the mechanical male connector 248 of the terminal 242, 244 to form a mechanical plug connection.

The fuse canister 210 may further include the electrical canister connector 224, 225 arranged at at least one of the fuse mounting openings 218, 220, 222 for electrically connecting to the electrical terminal connector 254. Preferably a pair of electrical canister connectors 224, 225 is arranged at a corresponding pair of the fuse mounting openings 218, 220. Optionally, further fuse mounting openings may be provided without electrical canister connector.

At least one of the electrical canister connectors 224, 225 (e.g., one electrical canister connector 224 of a pair of electrical canister connectors 224, 225) may be adapted to be selectively arranged at either one of the fuse mounting openings 220, 222 for electrically connecting to the electrical terminal connector 254 (e.g., one of a pair of electrical terminal connectors 254) when the (respective) mechanical plug connection is inserted into the selected one of the fuse mounting openings 220, 222.

At least one of the electrical canister connectors 224, 225 (e.g., the other electrical canister connector 225 of the pair of electrical canister connectors) may be adapted to be fixedly arranged at a predetermined one of the fuse mounting openings 224 for electrically connecting to the electrical terminal connector 254 (e.g., the other one of the pair of electrical terminal connectors 254) when the (respective) mechanical plug connection is inserted into the predetermined fuse mounting opening 224.

Based on the described structure of the fuse adapter kit 200, an electrical connection between an axial end portion 142 of the fuse 140 and an outer region of the fuse canister 210 may be established. Especially, the electrical connection may be established via the following electrical connection items which are connected to each other as a chain:

axial end portion 142 of the fuse 140,
electrical terminal connector 254,
electrical canister connector 224, 225, and
electrical connector in the outer region of the fuse canister.

The chain of connection electrical items 140-254-224 enables an electrical connection to be made between i) one end of the fuse 140 and ii) an earthing switch or an earthing conductor linked to the electrical connector located in the outer region of the fuse canister 210, when the fuse 140 is inserted into the fuse canister 210.

A technical effect of the kit structure, wherein the fuse canister 210 has a plurality of openings 218-222, is that the fuse 140 can be inserted into or removed from fuse canister 210 to be exchanged for a fuse 140 with different parameters, such as a different length. This technical effect is beneficial based on that the switch-fuse module can be used for fuses of different types and/or from different manufacturers. This advantageously results in increased flexibility for the customer.

Based on the described structure of the fuse adapter kit 200, a mechanical connection between i) one end of the fuse 140 and ii) a fuse mounting opening 218, 220, 222 may be established. Especially, the mechanical connection may be established via the following mechanical connection items which are connected to each other as a chain:

- an axial end portion 142 of the fuse 140 matching an axial (mechanical) fuse receiving opening 250 of the terminal 242, 244, wherein preferably the fuse end portion 142 and the terminal opening 250 form a mechanical plug connection, and
- a lateral protrusion 248 of the terminal 242, 244 forming a mechanical male connector matching a fuse mounting opening 218, 220, 222 forming a mechanical female connector, wherein preferably the male and female connectors form a mechanical plug connection.

The chain of mechanical connection items 140-250-248-(218,220,222) enables a mechanical connection to be made between i) one end of the fuse 140 and ii) a fuse mounting opening 218, 220, 222, when the fuse 140 is inserted into the fuse canister 210. The end of the fuse 140 provides an electrical as well as a mechanical link to the terminal 242, 244 and thus forms the first member of both the electrical and the mechanical chain.

Allowing fuses 140 of different lengths to be inserted into the fuse canister 210 is related to the usage of different fuse types, each having different parameters, for example different electrical parameters. So, a technical effect of the kit structure providing the basis for fuses 140 of different lengths and thus also of different types to be inserted into the fuse canister 210 is that the switch-fuse module can be used for i) voltages or currents of different magnitudes, and/or ii) fuse environments with different technical parameters such as composition, temperature, or pressure. The fuse environment can be a gas within the fuse canister or a fuse compartment, or elements connected to the fuse 140. This technical effect is beneficial in that adaptation to electrical customer requirements is made possible without additional costs, which is associated with competitive advantages.

According to embodiments, the mechanical terminal connector 248 may be tubular shaped. The mechanical terminal connector 248 may have the electrical terminal connector 254 arranged inside the tube, i.e. the tubular shaped connector 248, preferably along a tube axis.

According to embodiments, the electrical terminal connector 254 may be configured as a sliding pin 254. According to embodiments, the electrical terminal connector 254 may include a fuse-connecting portion 252 that preferably allows the pin 254 to axially slide along the axial end portion 142 of the fuse 140. The electrical terminal connector 254 may be arranged in the fuse receiving opening 250 of the terminal 242, 244 for establishing an electrical connection to the axial end portion 142 of the fuse 140 received in the fuse receiving opening 250.

A technical effect the structure of the electrical terminal connector 254 allowing axial shifting or sliding of the connector 254 along the axial end portion 142 of the fuse 140 is that a certain tolerance is allowed for the fuse length, so that small deviations from standard fuse lengths are allowed. This technical effect is beneficial based on that it increases flexibility and allows for example using fuses of different types and sizes in an efficient manner and in particular using the same standardized parts, preferably reducing the requirements concerning the components involved, which results in a corresponding cost reduction.

According to embodiments, the mechanical terminal connector 248 and/or the electrical terminal connector 254 may extend along a direction orthogonal to a fuse axis 144, and may be preferably co-axial with respect to the connector direction According to embodiments, the at least one terminal may include a first terminal 242 and a second terminal 244. According to embodiments, the electrical terminal connector 254 of the first terminal 242 may be electrically connectable (connected when inserted into the corresponding fuse mounting opening 218 forming the corresponding mechanical female connector) via the electrical canister connector 224 to a corresponding internal bushing 128 that preferably is electrically connected to a switch disconnector 300 located inside a switch enclosure 102 of the switch-fuse module 100. Preferably, the electrical terminal connector 254 of the first terminal 242 is also connected to a (second) earthing switch being, e.g., located inside the switch enclosure 102 and/or electrically arranged between the terminal connector 254 and the switch disconnector 300. Thus, the electrical canister connector 224 may be connected to the corresponding internal bushing 128 and may be configured for being connected via the bushing to a disconnector and/or (second) earthing switch.

According to embodiments, the electrical terminal connector 254 of the second terminal 244 may be electrically connectable (connected when inserted into the corresponding fuse mounting opening 220 forming the corresponding mechanical female connector) via the electrical canister connector 225 and optionally via a corresponding bushing to a cable connection 130 for connecting to an external cable. According to embodiments, the electrical terminal connector 254 of the first terminal 242 may be electrically connectable to a first earthing switch 308 located inside the cable compartment 104, e.g., located behind the fuse receiving portion of the fuse canister 210 (e.g., behind or backwards of the fuse mounting wall portion) or even behind (backwards of) the fuse canister 210, preferably below the switch disconnector 300.

According to embodiments, the terminal 242, 244 may have a terminal housing 246, wherein the terminal housing 246 may be made of an electrically isolating and/or elastic material. The terminal housing 246 may determine or establish the axial fuse receiving opening 250 and/or the mechanical terminal connector 248. According to embodiments, the material of the terminal housing 246 may include at least one of: rubber, silicon, EPDM (ethylene propylene diene monomer rubber).

A technical effect of the terminal housing 246 being made of an elastic material consists in providing a sealing impact against water leakage or dielectric discharge. This technical effect is beneficial in that it allows improving the operational safety of the equipment. A further technical effect may be allowing i) small dimension deviations for the fuse 140 and/or fuse mounting openings 218-222, and/or ii) a wide fluctuation range for parameters such as temperature, pressure, humidity of the medium surrounding the terminal 242, 244, and/or iii) reducing the requirements concerning the number of standardized parts for manufacturing for a wide range of fuse types, which results in a corresponding cost reduction, and/or allowing a large customer flexibility with respect to variations in environmental and operational parameters such as temperature, pressure, humidity when deploying the fuse 140 and/or the switch-fuse module 100.

According to embodiments, an electrical canister connector 224, 225 may be arranged at least at a pair of the fuse mounting openings 218, 220, 222 or inside a pair of the fuse mounting openings 218, 220, 222. According to embodiments, the electrical canister connector 224, 225 may be tulip (e.g. tubular) shaped, thus preferably forming an electrical female connector matching the electrical terminal connector 254 that preferably forms an electrical male connector, especially for electrically connecting the electrical terminal connector 254 to the electrical canister connector 224, 225 to form an electrical connection, e.g. plug or pin-tulip connection, when the mechanical plug connection at the respective fuse mounting opening 218, 220, 222 is established.

A technical effect of the electrical plug connection between canister connector 224, 225 and terminal connector 254 is that the connection can be made and released easily and abrasion-free. This technical effect is beneficial based on increasing the equipment reliability and the user convenience.

According to embodiments, the at least three fuse mounting openings 218, 220, 222 may include i) a first opening 218 for the first terminal 242, especially for receiving the mechanical connector 248 of the first terminal 242, and/or ii) a second opening 220 for the second terminal 244, especially for receiving the mechanical connector 248 of the second terminal 244, and/or iii) at least one third opening 222 for receiving the mechanical connector 248 of the second terminal 244, the third opening 222 being arranged between the first 218 and the second 220 opening, at a second axial distance from the first opening 218 corresponding to a second fuse length which may be less than a first fuse length.

According to embodiments, the second opening 220 may be arranged at a first axial distance from the first opening 218, the first axial distance corresponding to a first fuse length. According to embodiments, the third opening 222 may be axially arranged above the second opening 220 and/or between the first 218 and the second 220 opening and/or evenly spaced from the first and second opening 218, 220.

The embodiment, wherein the first opening 218 is arranged at an axially upmost position and the second opening is arranged at an axially lowest position, is shown in FIG. 1*a*. Alternatively, the first opening 218 may be arranged at an axially lowest position and the second opening 218 may be arranged at an axially upmost position.

According to embodiments, the at least one third opening 222 may include at least two, or three, or five, or seven third openings 222. In case of a plurality of third openings 222, the choice of the spacing between the third fuse mounting openings 222 and from the second fuse mounting opening 220 makes it possible to determine the range of lengths of the fuses to be used, as well as how granular or coarse the dimensions of the fuses can be varied.

According to embodiments, the fuse adapter kit 200 may include at least one spacer sleeve 256 adapted for being inserted into the fuse receiving opening 250 of the terminal 242, 244, the sleeve 256 being configured to compensate a size difference between a diameter of the fuse receiving opening 250 of the terminal 242, 244 and a diameter of the fuse end piece. According to embodiments, the at least one spacer sleeve may include two spacer sleeves 256. According to embodiments, the spacer sleeve 256 can be made of an elastic material, preferably a compressible and/or expandable material, including for example at least one of: rubber, silicon, EPDM. Alternatively, the spacer sleeve 256 can be made of plastics or a metal.

A technical effect of the spacer sleeve 256 is that a certain tolerance is allowed for the fuse diameter, so that small deviations from standard fuse diameters are allowed. This technical effect is beneficial based on that it increases flexibility when using fuses of different types, preferably reducing the requirements concerning the mechanical manufacturing tolerances of the components involved, which results in a corresponding cost reduction.

According to embodiments, the fuse adapter kit 200 may include at least one sealing element 258, especially a sealing ring or a hose clamp, for providing a seal between the fuse 140 and the terminal 242, 244 receiving the axial end portion 142 of the fuse 140. According to embodiments, the at least one hose clamp may include two hose clamps, each one for providing a seal between the fuse 140 and the terminal 242, 244 receiving the axial end portion 142 of the fuse 140.

A technical effect of the sealing element 258 is to enable a tightness of the fuse 140 against a medium surrounding the fuse 140, for example against a gas. This technical effect is beneficial based on increasing the reliability and/or durability of the fuse 140.

According to embodiments, the fuse adapter kit 200 may include a fuse 140 receivable or received in the fuse receiving portion 214, wherein the terminal 242, 244 and the fuse 140 form a fuse-terminal unit.

According to embodiments, the fuse adapter kit 200 may include three fuse adapter kits 200. According to embodiments, the at least one fuse may include three fuses 140, wherein especially each of the three fuses 140 may be connected to one of three current phases.

According to embodiments, the fuse canister 210 may include a removable front cover 226 mounted at a canister front. According to embodiments, the fuse canister 210 may be shaped as i) an elongated cuboid or ii) a cylinder with circular or elliptic cross section.

Figure 2C:
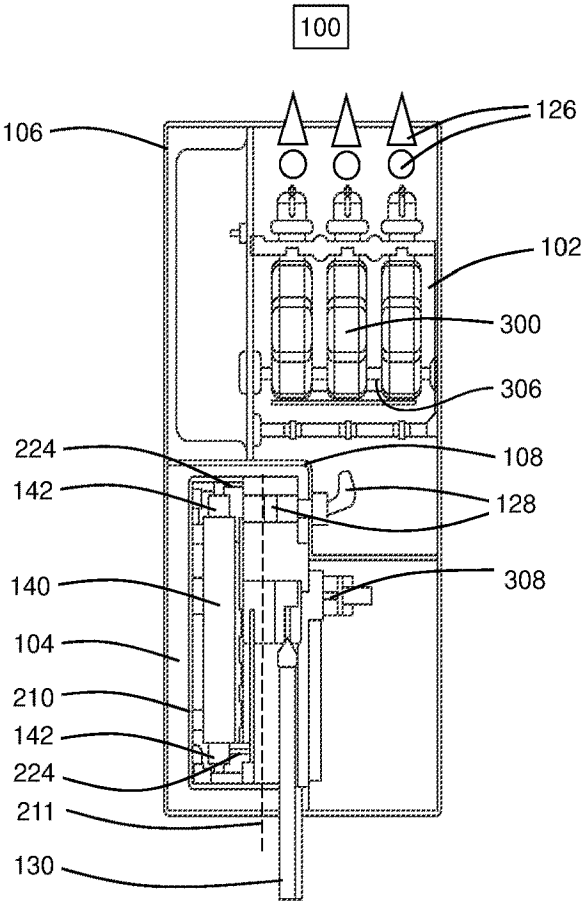
FIGS. 2*a*-2*c* respectively show a perspective 3D view, a schematic front view, and a schematic side view of a switch-fuse module according to embodiments described herein.
Figure 2B:
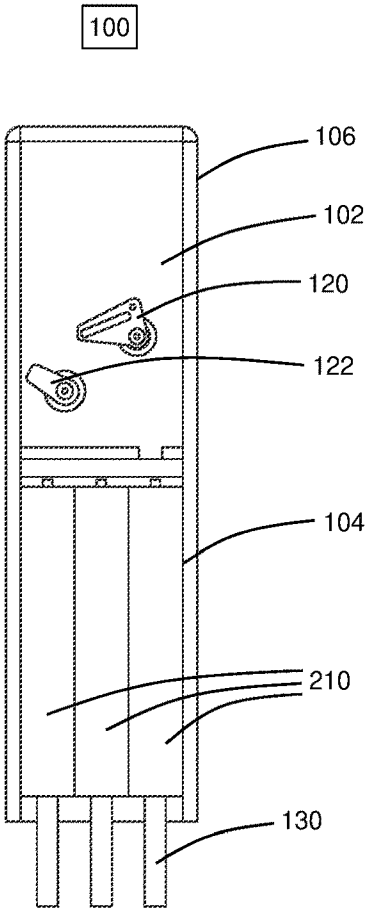
Figure 2A:
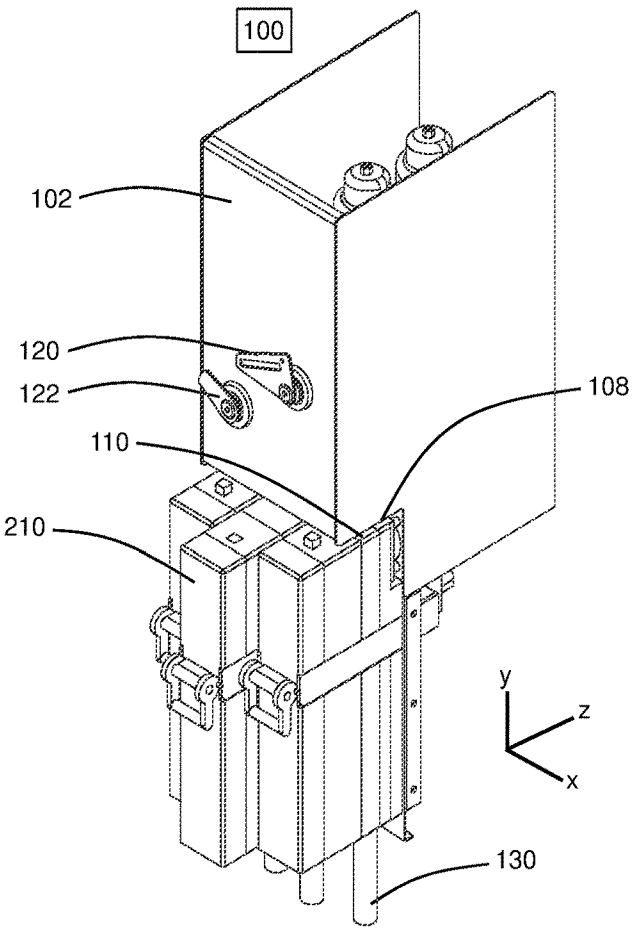

FIGS. 2*a*, 2*b*, 2*c* respectively show a perspective 3D view, a schematic front view and a schematic side view of a switch-fuse module, according to embodiments of the present invention. Details explained with illustrative reference to FIGS. 2*a*, 2*b*, 2*c* shall not be understood as limited to the elements of FIGS. 2*a*, 2*b*, 2*c*. Rather, those details may also be combined with further embodiments explained with illustrative reference to the other figures.

According to embodiments described herein, a switch-fuse module 100 is provided. The switch-fuse module 100 may include at least one fuse adapter kit 200.

According to embodiments described herein, the switch-fuse module 100 may include a housing 106 having therein the switch enclosure 102 including an insulating gas and a cable compartment 104 or fuse compartment that may be different and separate from the switch enclosure 102, at least one switch disconnector 300 arranged within the switch enclosure 102, and the fuse canister 210 with a vertically oriented longitudinal axis 211. The fuse canister 210 may be arranged within the cable compartment 104. The insulating gas may have a global warming potential less than a global warming potential of SF6. Preferably, the switch fuse module may be designed as a switch-fuse combination module.

Technical effects of the cable compartment 104 being different and separate from the switch enclosure 102 consist for example in that:

1. Existing production lines for known standard components such as those normally used with SF6 can be used for manufacturing the present equipment, resulting in that the switch-fuse module 100 can be manufactured without additional costs in production, which may well secure competitive advantages.
2. Pressure conditions and gas compositions in the respective compartments can be separately established and controlled, resulting in improved control options of the respective compartments depending on the technical requirements, and/or increased flexibility in terms of tailoring to customer requirements. For example, the cable compartment 14 does not need to be gas-tight and may be filled with ambient air at ambient pressure, whereas switch enclosure 12 may be filled with, potentially pressurized, dielectric gas other than ambient air.
3. A modular concept resulting in improved maintenance and service options. If a problem occurs in one unit, only that unit needs to be dealt with in terms of repair or replacement and the other remains unaffected.
4. The switch-fuse module 100 basically preserves the dimensions of standard equipment such as that normally used with SF6. This effect is beneficial for the user convenience, based on that users can easily integrate the present equipment into an existing standard environment, thus allowing to seamlessly exchange old modules for the present ones. This effect is also beneficial for the manufacturing process, based on that existing production lines for known standard components such as those normally used with SF6 can be used for manufacturing the present equipment, thus reducing production costs.
5. The horizontal footprint may be reduced to a minimum, i.e. the horizontal extension of the switch-fuse module 100 corresponding to the projection of the switch-fuse module 100 on the horizontal x-z plane, while at same time fully maintaining the structural stability or steadiness of the equipment.

According to embodiments, the switch disconnector 300 and/or the switch enclosure 102 may be arranged above the cable compartment 104. According to embodiments, the switch enclosure 102 and the fuse canister 210 may be arranged adjacently, preferably spaced from each other at a first distance 110. The first distance 110 may be at least 2 mm, 5 mm, or 10 mm, up to at most 20 mm, 40 mm, or 100 mm.

The technical effect of the switch enclosure 102 being arranged i) above the cable compartment 104 and/or ii) adjacently, and/or iii) spaced from each other at a first axial distance 110, consists in keeping to a minimum the horizontal footprint, i.e. the horizontal extension of the switch-fuse module 100 corresponding to the projection of the switch-fuse module 100 on the horizontal x-z plane, while at same time fully maintaining the structural stability or steadiness of the equipment. Furthermore, the distance between the units effects a good thermal insulation of the units against each other.

According to embodiments, the switch enclosure 102 may be separated from the cable compartment 104 by a step-like separating wall portion 108 defining or forming a lower volume portion of the switch enclosure 102 and a horizontally adjacent upper volume portion of the cable compartment 104. According to embodiments, the step-like separating wall portion 108 may have a vertical wall portion and/or a horizontal wall portion. The vertical wall portion and the horizontal wall portion may form the step-like separating wall portion 108.

According to embodiments, the step-like separating wall portion 108 of the switch enclosure 102 may form a step-like or staircase-shaped indentation 108 in a lower region of the switch enclosure 102. The indentation may be part of the switch enclosure 102. The cable compartment 104 may be partially placed in the indentation. According to embodiments, the indentation of the switch enclosure 102 may be cuboid-shaped.

The technical effect of the switch enclosure indentation 108 is that despite the vertical arrangement of the fuse canister 210 and/or of the arrangement of the switch enclosure 102 above the cable compartment 104, at least one electrical internal bushing 128 between the two units can be arranged laterally horizontally between the two units. This arrangement is space-saving and takes into account the component setup in the switch enclosure 102.

According to embodiments, the fuse 140 may be electrically connected at an end 142 to the switch disconnector 300 via the internal bushing 128 passing from the switch enclosure 102 into the cable compartment 104. Additionally, or alternatively, the fuse 140 may be electrically connected at a lower end 142 to one of a cable connection 130 for connecting to an external cable. The external cable may form a connection to an external network or may be part of the network. According to embodiments, the internal bushing 128 may travers the vertical wall portion of the step-like separating wall portion 108. According to embodiments, the fuse 140 may be configured to be accessible from the front of the switch-fuse module 100.

According to embodiments, each of the three fuses 140 may be connected to one of three current phases. Additionally, or alternatively, the three fuses 140 may be arranged substantially parallel to each other. Additionally, or alternatively, the three fuses 140 may be arranged substantially at the same vertical height, preferably with no vertical offset to each other. According to embodiments, the switch-fuse module 100 may be an AC switch-fuse module 100.

According to embodiments, each of the three fuses 140 may have a longitudinal axis 144. The axes may be arranged basically parallel to each other.

According to embodiments, the longitudinal axis 144 of a middle fuse 140 may be laterally offset with respect to the axes of the peripheral fuses 140. Additionally, or alternatively, the longitudinal axis 144 of the middle fuse 140 may be arranged outside of a plane defined by the axes 144 of peripheral fuses 140.

The technical effect of the longitudinal axis 144 of the middle fuse 140 being arranged outside of a plane defined by the peripheral fuses 140 is that the distance between fuses 140 is increased, resulting in improved dielectric insulation between the fuses 140.

According to embodiments, the at least one fuse canister 210 may include three fuse canisters 210, preferably each fuse canister 210 receiving one fuse 140. According to embodiments, the fuse canister 210 may be formed as an elongated cuboid. Alternatively, the fuse canister 210 may be cylindrically formed. According to embodiments, the fuse canister 210 may be arranged at least partially within the upper volume portion of the cable compartment 104.

According to embodiments, the cable connection 130 may be placed at a vertically higher position than the lower end 142 of the fuse 140. Alternatively, the cable connection 130 may be placed at a vertically lower position than an upper end 142 of the fuse 140. According to embodiments, the cable connection 130 may have a vertical height overlapping with the fuse 140. According to embodiments, the cable compartment 104 may include current and voltage sensors.

According to embodiments, the insulating gas may have a dielectric strength lower than the dielectric strength of SF6.

According to embodiments, the switch-fuse module 100 may be configured for a rated voltage in a range from 1 kV to 52 kV or 10 kV to 42 kV, preferably AC voltage.

According to embodiments, the switch disconnector 300 may be configured as a load-break switch (LBS). Especially, the switch disconnector 300 may be configured as an integrated two-position load break switch plus a separate, second earthing switch including an earthing shaft 306. The switch disconnector 300 may have two shafts: i) one shaft is operable by a handle 120 and is used to open or close the main line, and ii) the other shaft 306 is operable by a handle 122 and is used to open or earth the main line.

According to embodiments, the switch-fuse module may include a at least one external bushing 126 at a top side or lateral side of the switch compartment connecting the switch disconnector 300 to electrical components external to the switch-fuse module such as a network. The at least one external bushing may include three connector bushings 126.

According to embodiments, the switch-fuse module 100 may include a second earthing switch that is arranged in the switch enclosure 102 between the internal bushing 128 and the switch disconnector 300.

According to embodiments, the at least one canister 210 may include three canisters 210. Each canister 210 may receive one fuse 140.

According to embodiments, the switch enclosure 102 and the cable compartment 104 may be gas-tight with respect to each other. That means that the switch enclosure 102 and cable compartment 104 may be isolated from each other in a gas-tight manner. This effects the possibility that pressure conditions in the switch enclosure 102 can be autonomously and/or independently from each other established and controlled. This effect is beneficial based on improved control options of the switch enclosure 102 depending on the technical requirements, and/or increased flexibility in terms of tailoring to customer requirements.

According to embodiments, the switch enclosure (or switch compartment) 102 or the cable compartment 104 may be configured as a pressurised tank.

According to embodiments, the switch-fuse module 100 may be configured for a rated voltage in a range from 1 kV to 52 kV.

Some embodiments relating to the geometry and dimensions of the switch-fuse module 100 are described as follows.

The switch-fuse module 100 including the switch-fuse module 100 may have a height of more than 1000 mm and/or less than 1750 mm, or alternatively more than 1000 mm and/or less than 2000 mm. For example, the switch-fuse module 10 may have a height of less than 1750 mm.

The switch-fuse module 100 may have a depth of more than 500 mm and/or less than 850 mm, or alternatively more than 500 mm and/or less than 1000 mm. For example, the switch-fuse module 100 may have a depth of less than 850 mm.

The switch-fuse module 100 may have a width of more than 300 mm and/or less than 800 mm, or alternatively more than 300 mm and/or less than 1000 mm. For example, the switch-fuse module 100 may have a width of less than 800 mm.

It may be understood that a larger switch-fuse module 100 dimensions may be suitable for a higher rated voltage. For example, a switch-fuse module 100 may be for a rated voltage in a range from 1 kV or 12 kV to 24 kV, with a height of more than 1000 mm and/or less than 1750 mm, depth of more than 500 mm and/or less than 800, and/or width of more than 300 mm and/or less than 850 mm, while a switch-fuse module 100 may be for a rated voltage in a range from 36 kV to 42 kV, with a height of more than 1000 mm and/or less than 2000 mm, depth of more than 500 mm and/or less than 1000, and/or width of more than 400 mm and/or less than 1000 mm.

Some embodiments relating to the fuse 140 and switch-disconnector are described as follows.

In some embodiments, up to five switches, e.g. disconnector-switches, and/or panels, e.g. general panels, may be included in the switch enclosure 102.

A puffer switching device or vacuum interrupter may be utilised as the switch-disconnector. Alternatively, a puffer switching device may be utilised in addition to the switch-disconnector. Alternatively, a vacuum interrupter may be utilised. The puffer switching device may include a fixed tulip contact. The fixed tulip contact may be connected to the busbar. The puffer switching device may include a linearly sliding electrode, a blowing compression chamber, and/or blowing ports. The puffer switching device may include a rotating shaft to disconnect the line, which may be a load break shaft for example. The switch enclosure 102 may cover the load break shaft of the panel.

Some embodiments relating to the insulating gases are described as follows.

The switch enclosure 102 may be configured as a pressurized tank containing each an insulating gas with dielectric strength lower than dielectric strength of SF6. The pressurized tank may be configured to be filled, for example during installation and/or commissioning, to an absolute pressure in a range from 1.0 bar to 2 bar, preferably in a range from 1.3 bar to 1.4 bar.

Global warming potential may be understood to be assessed over an interval of 100 years, relative to CO2 gas. SF6 may be considered to have a global warming potential of 22,200 times that of CO2 over a 100-year period. The insulating gases having dielectric strength lower than dielectric strength of SF6 include at least one gas component selected from the group consisting of: CO2, O2, N2, H2, air, N2O, a hydrocarbon, in particular CH4, a perfluorinated or partially hydrogenated organofluorine compound, and mixtures thereof. In further embodiments, the insulating gases include a background gas, in particular selected from the group consisting of: CO2, O2, N2, H2, air, in a mixture with an organofluorine compound selected from the group consisting of: fluoroether, oxirane, fluoramine, fluoroketone, fluoroolefin, fluoronitrile, and mixtures and/or decomposition products thereof. For example, the insulating gases may include dry air or technical air. Each of the insulating gases may be a dielectric insulating medium. The insulating gases may in particular include an organofluorine compound selected from the group consisting of: a fluoroether, an oxirane, a fluoramine, a fluoroketone, a fluoroolefin, a fluoronitrile, and mixtures and/or decomposition products thereof. In particular, the insulating gases may include as a hydrocarbon at least CH4, a perfluorinated and/or partially hydrogenated organofluorine compound, and mixtures thereof. The organofluorine compound is preferably selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. The insulating gases preferably includes the fluoroketone mixed with air or an air component such as N2, O2, and/or CO2.

In specific cases, the fluoronitrile mentioned above is a perfluoronitrile, in particular a perfluoronitrile containing two carbon atoms, and/or three carbon atoms, and/or four carbon atoms. More particularly, the fluoronitrile can be a perfluoro-ialkylnitrile, specifically perfluoro-iacetonitrile, perfluoro-ipropionitrile (C2F5CN) and/or perfluorobutyronitrile (C3F7CN). Most particularly, the fluoronitrile can be perfluoro-isobutyro-initrile (according to formula (CF3)2CFCN) and/or perfluoro-2-methoxypropanenitrile (according to formula CF3CF(OCF3)CN). Of these, perfluoroisobutyronitrile is particularly preferred due to its low toxicity.

As an example, the switch-fuse module 100 can operate with air, dry air, and/or a gas mixture including air for a rated voltage in a range from 1 kV to 52 kV, for example 12 kV or a 12 kV rated switchgear. In another example, the switch-fuse module 100 can operate with a gas mixture including a C5 perfluoroketone and/or air, for a rated voltage in a range from 1 kV to 52 kV, for example 24 kV or a 24 kV rated switchgear.

Some embodiments relating to the first earthing switch 308 and second earthing switch are described hereinafter.

The first earthing switch 308 may be horizontally mounted in the cable compartment 104. The second earthing switch may be mounted below the switch disconnector 300. The second earthing switch may be configured to earth the upper fuse end 142. The first earthing switch 308 may be configured for earthing the lower fuse end 142. The upper and/or lower fuse end 142 may be an electrical conductive side of the fuse 140.

The first earthing switch 308 and the second earthing switch may be configured to be operated substantially simultaneously and/or jointly connected to a common actuating mechanism. Especially, both upstream and downstream of the fuse 140 may be simultaneously grounded. In this document, upstream and downstream are related to the direction of the energy flow.

Some embodiments relating to elements of the switch-fuse module 100 are described as follows.

The switch-fuse module 100 may be configured for a rated voltage in a range from 1 kV to 52 kV, or from 1 kV to 42 kV, or from 10 kV to 42 kV, or from 12 kV to 42 kV, or for 12 kV and 24 kV and/or 36 kV and/or 40.5 kV. In one particular example, it may be understood that a 24 kV rated unit may fulfil dielectric withstand of at least 125 kV lightning impulse.

The first distance between the switch enclosure 102 and the canister 210 or canister end may provide dielectric capability for a rated voltage, for example for a rated voltage in a range from 1 kV to 52 kV.

The switch-fuse module 100 may include at least one busbar. In an example, the busbar may be a metallic strip or bar, and/or may be housed inside a switchgear, a panel board, and/or busway enclosures, and in some examples, suitable for local and/or high current power distribution and/or suitable for connecting high voltage equipment. The busbar may be arranged substantially parallel to a vertical plane that includes the switch-disconnector, and/or in a horizontal direction or alternatively in a vertical direction, and/or perpendicular to the fuse axis 144.

A space between the fuse 140 or the electrical linkage of the fuse 140, and the enclosure walls provides dielectric capability for a rated voltage in a range from 1 kV to 52 kV. In an exemplarily embodiment, at least one busbar may be arranged at a second distance above the switch-disconnector, wherein the second distance may be at least a distance dielectrically suitable for a rated voltage in a range from 1 kV to 52 kV in the presence of the insulating gases at operating conditions.

The switch-fuse module 100 may be adapted to protect a transformer that may be part of an electrical network.

The switch-fuse module 100 may be interconnected, e.g., via a busbar, to further panels and/or switchboards interconnected by the busbar, thereby constituting a switchgear including the panels and/or switchboards including the switch-fuse module 100. The switch fuse module may be an outermost panel of a switchgear. Where the switch-fuse module 100 is the outermost panel of a switchgear, extensions of top or side bushings may be mounted. A positioning of components such as the fuse 140, the electrical linkage, the busbar and/or the switch-disconnector may provide the needed dielectric strength. The external surface of conductive materials may be configured to provide the needed dielectric strength.

This written description uses examples to disclose the disclosure, including the best mode, and also to enable any person skilled in the art to practice the described subject-matter, including making and using any apparatus or system. Embodiments described herein provide a fuse adapter kit and a switch-fuse module, wherein an easy and flexible adaptation of the equipment to changing urban requirements in a cost-effective manner is provided. While various specific embodiments have been disclosed in the foregoing, mutually non-exclusive features of the embodiments described above may be combined with each other. The patentable scope is defined by the claims, and other examples are intended to be within the scope of the claims if they have structural elements that do not differ from the literal language of the claims, or if they include equivalent structural elements with insubstantial differences from the literal language of the claims.

The invention claimed is:

1. A fuse adapter kit for a fuse of a switch-fuse module, the fuse adapter kit comprising:

at least one terminal having i) an axial fuse receiving opening for receiving an axial end portion of the fuse, ii) a lateral protrusion forming a mechanical male connector, and iii) an electrical terminal connector laterally arranged within the mechanical male connector for electrically connecting the fuse to an electrical canister connector; and a fuse canister having an axially elongated fuse receiving portion adapted to receive the fuse, wherein the fuse canister includes a fuse mounting wall portion extending axially along a back side of the fuse receiving portion, the fuse mounting wall portion having at least three fuse mounting openings at different axial positions along the fuse mounting wall portion, each of the fuse mounting openings forming a mechanical female connector matching the mechanical male connector of the terminal, to form a mechanical plug connection, and wherein the fuse canister further includes the electrical canister connector arranged at at least one of the fuse mounting openings for electrically connecting to the electrical terminal connector.

2. The fuse adapter kit according to claim 1, wherein the mechanical male connector of the terminal is tubular shaped, having the electrical terminal connector arranged inside the tube.

3. The fuse adapter kit according to claim 1, wherein the electrical terminal connector comprises a fuse-connecting portion arranged in the fuse receiving opening of the terminal for being connected to the axial end portion of the fuse received in the fuse receiving opening; or the electrical terminal connector is configured as a sliding pin.

4. The fuse adapter kit according to claim 1, wherein the at least one terminal comprises a first terminal and a second terminal.

5. The fuse adapter kit according to claim 1, wherein the at least one terminal comprises a first terminal and a second terminal, wherein the electrical terminal connector of the first terminal is electrically connectable via the electrical canister connector to a corresponding internal bushing.

6. The fuse adapter kit according to claim 1, wherein the at least one terminal comprises a first terminal and a second terminal, wherein the electrical terminal connector of the second terminal is electrically connectable via the electrical canister connector to a corresponding earthing switch located inside the cable compartment, behind the fuse receiving portion.

7. The fuse adapter kit according to claim 1, wherein the terminal has a terminal housing, wherein the terminal housing is made of an electrically isolating or elastic material.

8. The fuse adapter kit according to claim 1, wherein the terminal has a terminal housing, wherein the terminal housing defines the axial fuse receiving opening or the mechanical male connector.

9. The fuse adapter kit according to claim 1, wherein the electrical canister connector is arranged at least at or inside a pair of the fuse mounting openings.

10. The fuse adapter kit according to claim 1, wherein the electrical canister connector is a tulip contact.

11. The fuse adapter kit according to claim 1, wherein the electrical canister connector is a tulip contact forming an electrical female connector matching the electrical terminal connector.

12. The fuse adapter kit according to claim 1, wherein the electrical canister connector is a tulip contact forming an electrical female connector matching the electrical terminal connector that forms an electrical male connector.

13. The fuse adapter kit according to claim 1, wherein the at least three fuse mounting openings comprise i) a first opening for the first terminal, and ii) a second opening for the second terminal, and iii) at least one third opening for receiving the mechanical connector of the second terminal, the third opening being arranged between the first and the second opening, at a second axial distance from the first opening corresponding to a second fuse length which is less than a first fuse length.

14. The fuse adapter kit according to claim 1, wherein the at least three fuse mounting openings comprise i) a first opening for the first terminal, and ii) a second opening for the second terminal, the second opening being arranged at a first axial distance from the first opening, the first axial distance corresponding to a first fuse length.

15. The fuse adapter kit according to claim 1, wherein the at least three fuse mounting openings comprise i) a first opening for the first terminal, and ii) a second opening for the second terminal, and iii) at least one third opening for receiving the mechanical connector of the second terminal, the third opening being axially arranged above the second opening or between the first and the second opening or evenly spaced from the first and second opening.

16. The fuse adapter kit according to claim 1, further comprising at least one spacer sleeve adapted for being inserted into the fuse receiving opening of the terminal, the sleeve being configured to compensate a size difference between a diameter of the fuse receiving opening of the terminal and a diameter of the fuse end piece.

17. The fuse adapter kit according to claim 1, further comprising at least one sealing element, or a sealing ring or a hose clamp, for providing a seal between the fuse and the terminal receiving the axial end portion of the fuse.

18. The fuse adapter kit according to claim 1, wherein the fuse canister comprises a removable front cover mounted at a canister front;

or the fuse canister is shaped as i) an elongated cuboid or ii) a cylinder with circular or elliptic cross section.

19. The fuse adapter kit according to claim 1, wherein the at least one fuse comprises three fuses.

20. The fuse adapter kit according to claim 1, wherein the at least one fuse comprises three fuses, the longitudinal axis of a middle fuse being i) laterally offset with respect to the axes of the peripheral fuses, or ii) arranged outside of a plane defined by the peripheral fuses.

21. The fuse adapter kit according to claim 1, wherein the at least one fuse comprises three fuses, each of the three fuses being connected to one of three current phases.

22. A switch-fuse module comprising at least one fuse adapter kit including:

at least one terminal having i) an axial fuse receiving opening for receiving an axial end portion of the fuse, ii) a lateral protrusion forming a mechanical male connector, and iii) an electrical terminal connector laterally arranged within the mechanical male connector for electrically connecting the fuse to an electrical canister connector; and a fuse canister having an axially elongated fuse receiving portion adapted to receive the fuse, wherein the fuse canister includes a fuse mounting wall portion extending axially along a back side of the fuse receiving portion, the fuse mounting wall portion having at least three fuse mounting openings at different axial positions along the fuse mounting wall portion, each of the fuse mounting openings forming a mechanical female connector matching the mechanical male connector of the terminal, to form a mechanical plug connection, and wherein the fuse canister further includes the electrical canister connector arranged at at least one of the fuse mounting openings for electrically connecting to the electrical terminal connector.

23. The switch-fuse module according to claim 22, wherein the switch-fuse module comprises three fuse adapter kits.

* * * * *